US005209323A

United States Patent [19]

Hopkins

[11] Patent Number: 5,209,323

[45] Date of Patent: May 11, 1993

[54] INTERIOR FIRE ESCAPE CHUTE FOR A BUILDING

[76] Inventor: Sherlene Hopkins, 11827 Ohio, Detroit, Mich. 48204

[21] Appl. No.: 919,425

[22] Filed: Jul. 23, 1992

[51] Int. Cl.[5] ..... A62B 1/20

[52] U.S. Cl. ..... 182/48; 193/12; 52/187

[58] Field of Search ..... 182/48, 49; 193/12, 193/13; 25 R; 52/187, 176

[56] References Cited

U.S. PATENT DOCUMENTS

| | | | |
|---|---|---|---|
| 3,458,009 | 7/1969 | Favors | 182/48 |
| 3,580,358 | 8/1969 | Yamamoto | 182/48 |
| 3,838,750 | 9/1973 | Williams, Jr. | 182/48 |
| 3,910,532 | 4/1974 | Fischer | 244/137 |
| 3,915,258 | 10/1975 | Nusslein | 182/48 |
| 5,060,753 | 1/1991 | Hopkins | 182/48 |

FOREIGN PATENT DOCUMENTS

| | | | |
|---|---|---|---|
| 2100886 | 8/1972 | Fed. Rep. of Germany . | |
| 2441887 | 3/1976 | Fed. Rep. of Germany | 182/48 |
| 2261784 | 2/1974 | France | 182/48 |
| 2101977 | 2/1977 | Japan . | |
| 2152887 | 1/1984 | United Kingdom . | |

*Primary Examiner*—Alvin C. Chin-Shue
*Attorney, Agent, or Firm*—Dykema Gossett

[57] ABSTRACT

A fire escape chute for a building having a plurality of floors, hallways, and a plurality of pairs of apartments on each floor, includes a plurality of spaced descending spiral-shaped chute segments extending between floors. Each segment has an entrance on one floor and an exit on a floor below. A downwardly inclined escape chute for one of each of the pairs of apartments has an entrance opening on an interior wall of one of the pairs of apartments and an exit opening connected to an adjacent chute segment. A downwardly inclined escape branch chute for the other of each pair of apartments has at one end an entrance opening within an interior wall of the other of the pairs of apartments and an exit connected to the adjacent escape chute.

15 Claims, 3 Drawing Sheets

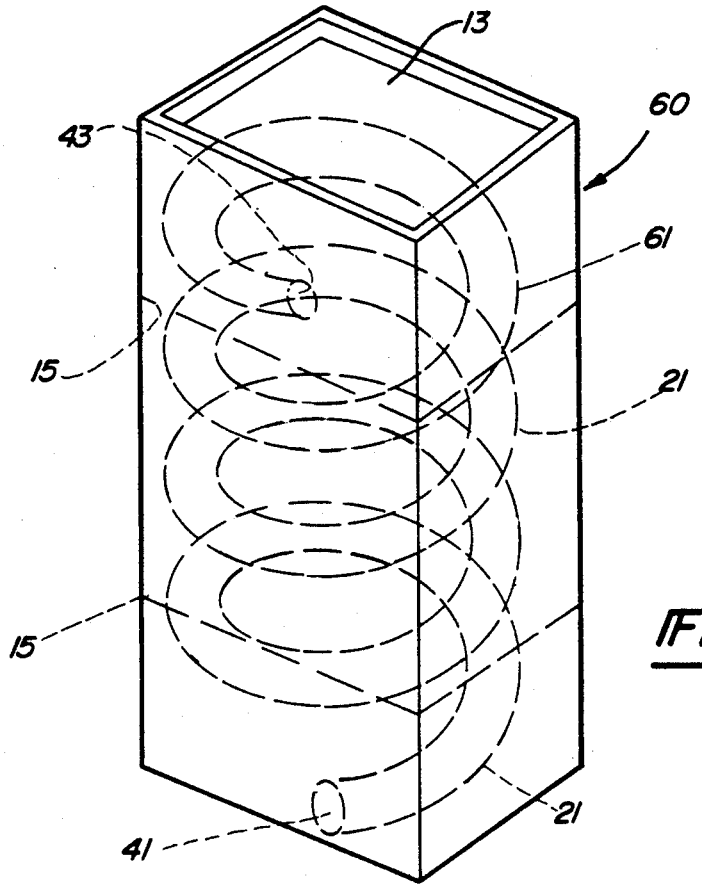
Fig-5
Fig-6
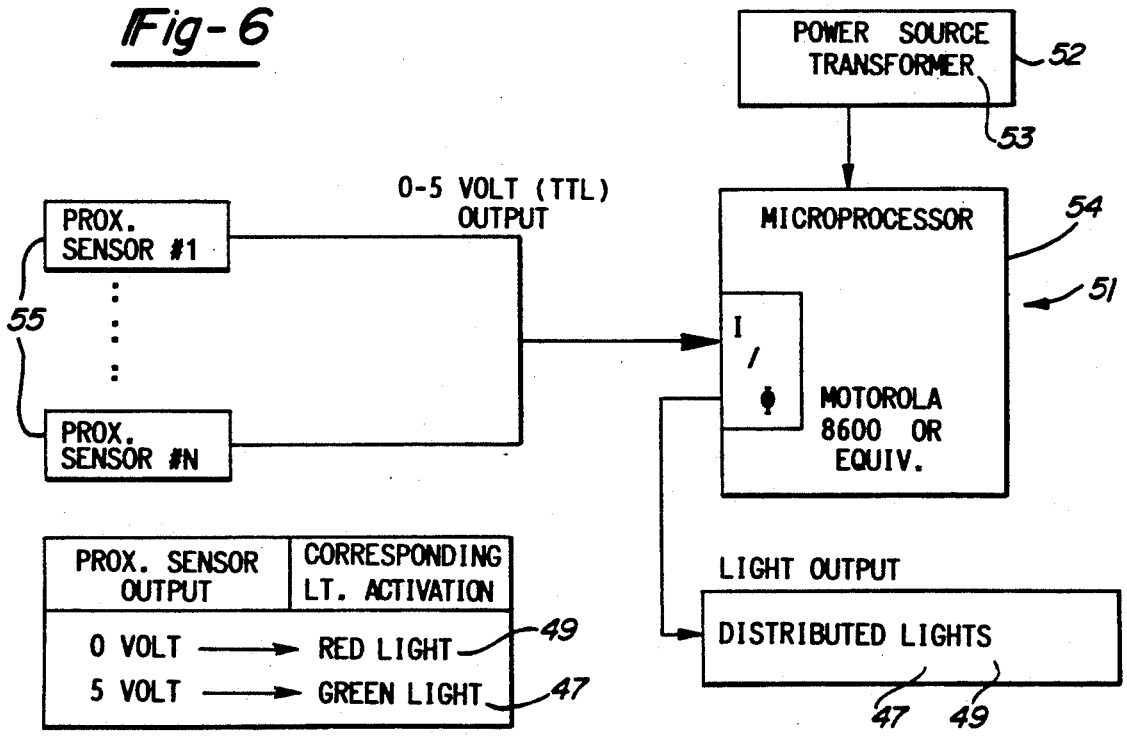

INTERIOR FIRE ESCAPE CHUTE FOR A BUILDING

FIELD OF THE INVENTION

A fire escape chute for a building having a plurality of floors with a spiral chute or series of spiral chute sections for escape upon the building interior.

BACKGROUND OF THE INVENTION

In case of a fire people occupying apartments on the respective floors of a building normally try to escape using the stairs if not blocked by flames or smoke. Alternately they are rescued by fire departments from the exterior of the building up to certain limited heights.

It is believed known that efforts to escape apartments have been tried by the use of strands of rope or any other support such as interconnected sheets, which have in some cases permitted the escape of persons out of a window avoiding the alternative of jumping.

THE PRIOR ART

Examples of prior art efforts to escape a fire from a building or an airplane are shown in one or more of the following patents listed chronologically:

| PATENT NUMBER | DATE | INVENTOR |
|---|---|---|
| 3,458,009 | July 29, 1969 | J. E. Favors |
| 3,580,358 | May 25, 1971 | Yamamoto |
| 3,838,750 | October 1, 1974 | Williams, Jr., et al |
| 3,910,532 | October 7, 1975 | Fischer |
| 4,582,166 | April 15, 1986 | Baker |
| 5,060,753 | October 29, 1991 | Hopkins |
| FOREIGN PRIOR ART | | |
| German Patent 2 100 886 | August 10, 1972 | Dezso Rakosi |
| United Kingdom 2 152 887 A | January 18, 1984 | David Raymond Rennison |
| Japanese Patent 52-18100 | January 1, 1975 | Kenkyusho |

SUMMARY OF THE INVENTION

An important feature of the present invention is to provide an interior fire escape chute for building having a plurality of floors with hallways and a plurality of side-by-side pairs of apartments with interior walls on each floor.

It is another feature to provide a plurality of vertically-spaced aligned descending spiral chute segments positioned within the building and extending between adjacent floors with each segment having an entrance on one floor and an exit on the succeeding floor below.

It is another feature to provide for one of each of the pairs of apartments on one floor of a downwardly inclined escape chute positioned within the building, with each escape chute having at one end an entrance opening within an interior wall of said one apartment and an exit opening at its other end. The escape chute at its exit opening is connected to, merges with and communicates with an adjacent chute segment for passage of a person thereinto.

It is another feature to provide a downwardly inclined escape branch chute for the other of each of said pairs of apartments, positioned within said building. Each escape chute has at one end an entrance opening within an interior wall of said other apartment and an exit opening at its other end. The branch chute at its exit opening is connected to, merges and communicates with an adjacent escape chute for passage of a person thereinto and successively into the adjacent chute segment.

It is another feature of the present invention to provide that all of the persons using the escape chute and escape branch chutes successively pass therethrough and the adjacent chute segment and successively exiting upon the adjacent lower floor.

As another feature persons exiting one chute segment walk a distance upon the adjacent hallway and enter the entrance of the adjacent successive chute segment for successive passage to adjacent floors and through the succeeding chute segments to the ground floor.

It is another feature to provide for the respective entrances in the apartments to the escape chute and eacape branch chute a hinged door with a handle upon a wall in each apartment, normally biased closed, extending over the entrance opening respectively of said escape chutes and escape branch chutes, limiting access thereto.

As another feature a childproof safety latch is provided upon each door preventing access to said chutes.

As another feature each door has provided thereover within an adjacent wall a safety access signal light, red and green with the red signal lights normally energized and including an electrical circuit with other signal lights for the doors in the respective other apartments for each floor and for succeeding floors together with a power source connected into the circuit and a switch mechanism in a circuit connected to the lights to progressively reverse energization of each red light for the safe progressive passage of persons into and through said escape chutes and escape branch chutes on a green light and permitting a progressive flow of users from adjacent pairs of apartments on each floor to the adjacent chute segment and for progressive passage through the respective succeeding chute segments.

It is another feature to provide a flat roof upon the building together with a penthouse or other enclosure with a normally closed door upon the roof and with the entrance opening of the top chute segment communicating with the penthouse to permit access and entry of persons on said roof to said top chute segment.

As another feature of the present invention the present interior fire escape chute for a building having a plurality of floors, hallways and a plurality of pairs of apartments in each floor includes a continuous descending spiral chute positioned within the building and including a plurality of connected spiral chute segments extending between adjacent floors. Said chute has an entrance at its top and an exit at the ground level or bottom floor of the building.

It is a further feature to provide the same type of entrance into the continuous chute for the respective floors by the use of said escape chute and escape branch chutes from the respective pairs of apartments for passage into the adjacent portion of the continuous spiral chute or into the corresponding chute segment making up a part of said continuous spiral chute.

These and other features and objects will be seen from the following specification and claims in conjunction with the appended drawings.

THE DRAWINGS

FIG. 5 is a schematic perspective view of a modified interior fire escape chute assembly employing a single continuous spiral chute.

FIG. 6 shows a schematic diagram for a signal light circuit.

It will be understood that the above drawings illustrate merely preferred embodiments of the invention, and that other embodiments are contemplated within the scope of the claims hereinafter set forth.

DETAILED DESCRIPTION OF AN EMBODIMENT OF THE INVENTION

Figure 1:
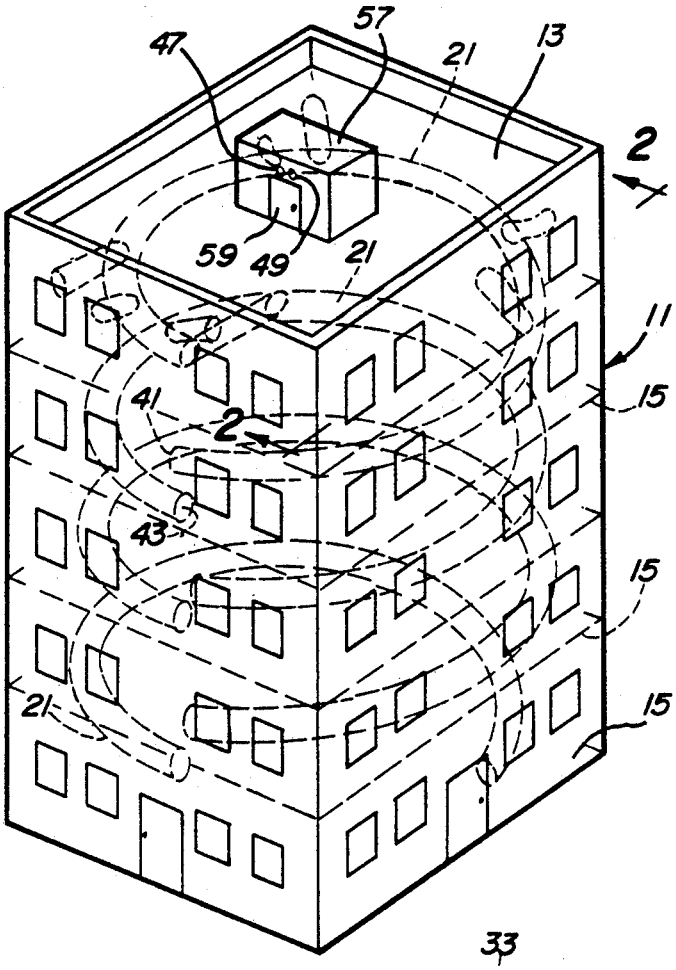
FIG. 1 is a schematic perspective view of a building having a plurality of floors and a plurality of pairs of apartments on each floor together with a plurality of spaced descending spiral chute segments shown in dash lines.
Figure 2:
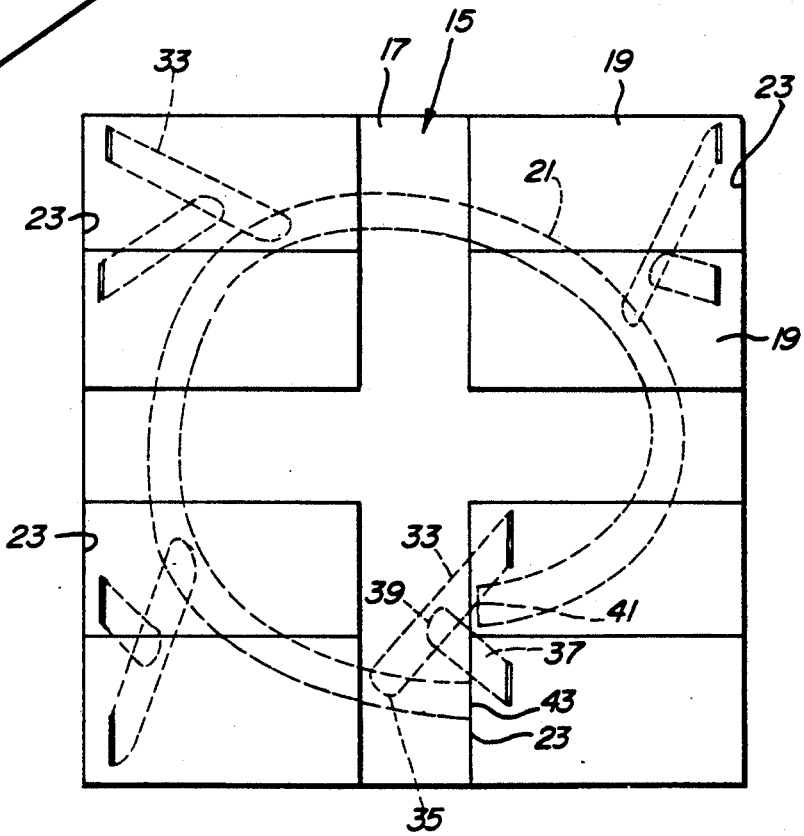
FIG. 2 is a plan view taken in the direction of arrows 2—2 of FIG. 1, on an increased scale including the respective escape chutes and escape branch chutes from adjacent pairs of apartments into the adjacent spiral chute segment.

Referring to the drawings an apartment or other building is generally designated at 11, FIGS. 1 and 5, including roof 13 a plurality of floors 15, including the lowermost ground floor and the hallways 17, FIG. 2 for each floor.

Positioned upon each floor are a plurality of side-by-side or adjacent apartments 19, in the illustrated embodiment, arranged in the respective corners of the building, FIG. 2.

The present interior fire escape chute for building 11 includes a plurality of descending spaced spiral chute segments 21. These are generally aligned vertically with the respective chute segments 21 extending between adjacent floors in the preferred embodiment. Alternately the chute segments may extend between one floor and a floor spaced two floors therebelow.

Figure 4:
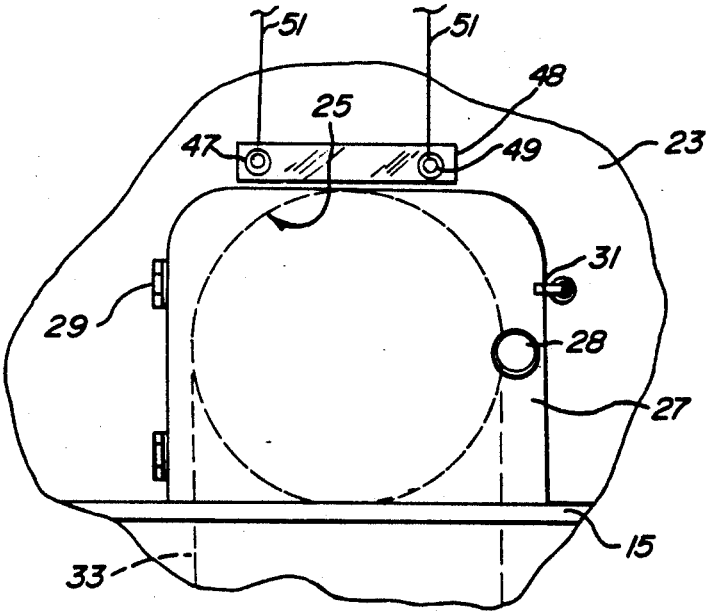
FIG. 4 is a fragmentary front elevational view of the normally closed door within the individual apartments on each floor closing off access to the corresponding escape chute or escape branch chute leading to the adjacent spiral chute segment shown in FIG. 3.

Each of the respective pairs of apartments includes a conventional wall 23, FIG. 4. Each wall has an entrance opening 25 adapted for communication with escape chute 33 or branch escape chute 37 to the underlying chute segment 21.

There is provided a door 27 with handle 28 hinged at 29 to wall 23. In the preferred embodiment the hinges 29 are spring biased hinges so that the door 27 is normally biased to the closed position shown. A safety latch 31, sometimes referred to as a childproof safety latch 15, is provided upon door 27 to prevent unauthorized opening of door 27.

Each of the respective pairs of adjacent apartments 19, sometimes referred to as the first or one apartment and the second or other apartment include in one of the walls 23 thereof an entrance opening 25. Said openings provide access of the person or persons within each apartment to escape chute 33 or branch escape chute 37 and the adjacent underlying chute segment 21.

For one of the pairs of apartments 19 there is employed an escape chute 33 and within the other of the adjacent pair of apartments an escape branch chute 37.

Each of the escape chutes 33 at its upper end has an entrance opening 25, FIG. 4, normally closed by door 27. Similarly, each of the escape branch chutes 37 also has an entrance opening 25 for the corresponding second of the pair of apartments 19. It is normally closed by a corresponding door 27, FIG. 4. Escape chute 33 is inclined angularly downward and at its lower end has a junction with and is connected at 35 to the adjacent chute segment 21 and is in communication therewith. This provides for passage of persons from said one of the pair of apartments 19 through escape chute 33 down into spiral chute segment 21 towards its exit 41. This exit is within hall 17 of floor 15 of the next adjacent floor therebelow.

The escape branch chute 37 at its lower end merges as at 39 with escape chute 33 and as suitably connected thereto providing communication therebetween. Accordingly a person or persons within the second of the pair of apartments 19 on opening of the corresponding door 27 to the entrance 25 can slide down the escape branch chute 37 and into the lower portion of escape chute 33 and ultimately into the descending underlying chute segment 21, FIG. 3.

In accordance with the present invention and wherein a plurality of spiral chute segments 21 are employed between adjacent floors, a person exiting the outlet 41 of chute segment 21 walks down the hallway 17 to a corresponding door, similar to door 27, FIG. 4, which is similarly hinged at 29. Said door has a handle 28 and a childproof safety latch 31. This door covers a corresponding entrance opening or floor entrance 43.

Figure 3:
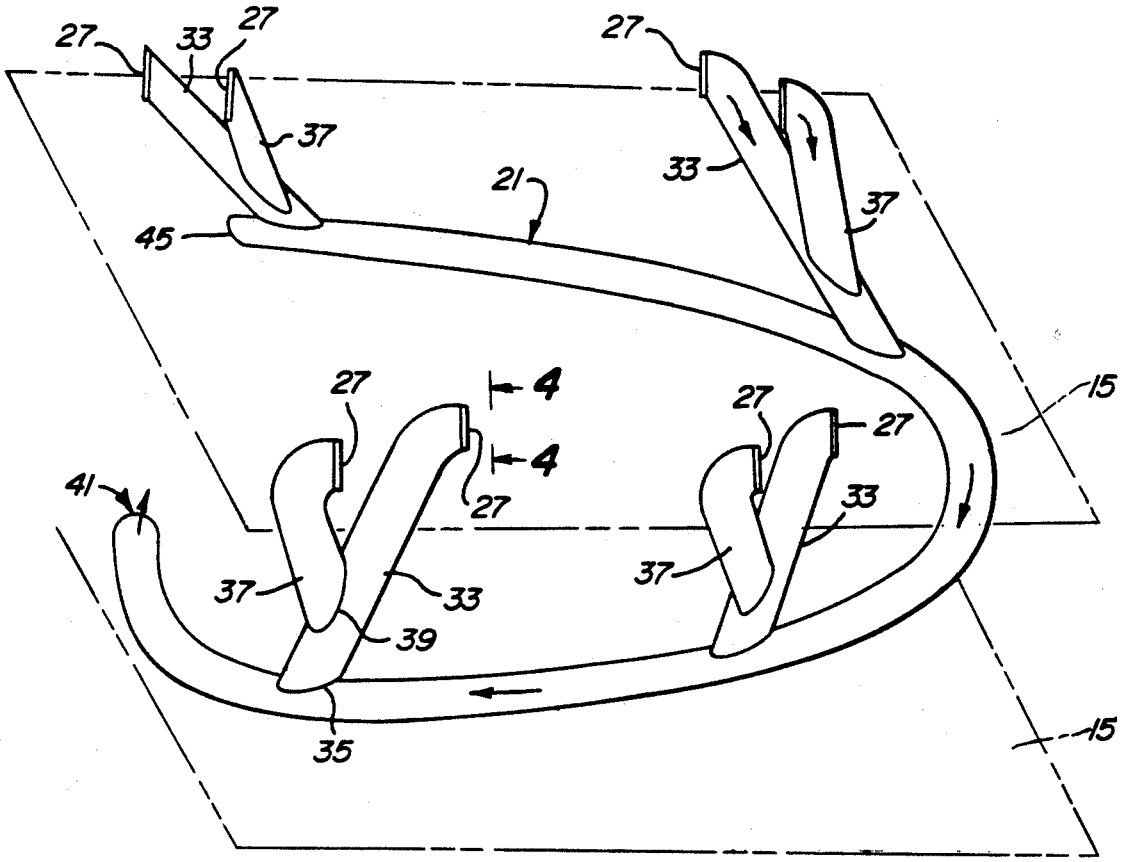
FIG. 3 is a fragmentary perspective view of a single spiral chute segment extending between a pair of adjacent floors of the building shown in FIG. 1, and upon an increased scale.

The respective occupants of the apartments of a particular floor such as an uppermost floor 15, FIG. 3, descend through the escape chute 33 and the escape branch chute 37. They will move successfully into the corresponding spiral chute segment 21 outletting at 41 onto the corresponding hallway 17. In that hallway on one of the apartment walls exterior there will be a door similar to door 27, FIG. 4, providing access to entrance opening 43 of the succeeding spiral segments respectively.

In the preferred embodiment the respective occupants of the apartments on one floor slid through escape chute 33 and escape branch chute 37 and the adjacent underlying chute segment 21. Each person exits the chute segment at 41 and floor 15. These people can proceed to the corresponding exterior wall entrance 25 for the succeeding chute segment 21.

The people who have collected upon the floor below the first floor mentioned can successively pass into entrance 43 for the next succeeding chute segment 21 for descending downwardly one or possibly two floors, depending upon the length of the chute segment.

This procedure is continued from floor-to-floor starting from the top floor down. This procedure includes a safety progression under a signal light system to permit safe access of users progressively from the top floor downwardly to the lower floors and thence to the bottom floor.

The top spiral segment 21 has a normally closed entrance 45, FIG. 3, which is normally adjacent penthouse 57. Said penthouse has a normally closed or locked door 59 providing access to roof 13 of the apartment or other building 11. The entrance opening 45 to the top spiral segment 21 is closely adjacent the interior of said penthouse so that it may be reached directly or by a short chute from the penthouse thereinto and for passage to and through top spiral segment 21.

The door 59, FIG. 1, is of a construction similar to door 27 described with respect to FIG. 4. It will be normally biased closed by spring hinges 29 and have a handle 28. It will also have a safety latch or lock to childproof or protect unauthorized entry into penthouse 57 and for access to the entrance 45 of top chute segment 21.

Referring to FIG. 4, there is provided upon wall 23, being an interior wall for any of the apartments 19, a green light 47 and a red light 49. These are connected into an electrical circuit 51 schematically shown in FIG. 6. The circuit includes a power source 52, transformer 53, and series of proximity or like switches 55. The respective red lights 49 are normally energized, except perhaps for the first green light 47 on the top floor of one of the pairs of apartments, or above penthouse door 59.

The schematic circuit 51 is illustrative for accomplishing the safe entry into the respective escape chute 33 or branch chute 37.

A series of proximity switches or sensors 55 #1 to 55 #N corresponding to each of the lights 47 and 49 on the respective floors 15 and within the respective apartments are all connected to the input of a microprocessor 54, FIG. 6. As illustrative, a MOTOROLA 8600 or equivalent may be used. Its output is adapted to control the respective distributed lights #1 to N, 47, 49, as shown in FIG. 4 for each entrance door 27 for apartments or for floor entry doors 43, FIG. 1.

The respective green lights 47 and red lights 49 are housed within traffic signal housing 48, which will show either red or green indicating that it is safe to enter a particular entrance 25 to the respective escape chute 33 or escape branch chute 37.

The primary object is that for the first of the pair of adjacent apartments the green light 47 has been energized and in the second of the pair of apartments the red light 49 has been energized. In all the succeeding apartments the red light is on. By the use of a proximity switch 55 or the like in circuit 51 the lights will be energized automatically from "red" to "green" once it is safe for the people in the second of the pair of apartments to use the escape branch chute 37, for illustration.

The electrical circuit will extend between the respective apartments 19 on their respective floors 15 and ultimately between the respective floors so that the safety lighting system will be such that the green light 47 will be energized only when it is safe to progressively enter the particular escape chute or branch chute of a pair of side-by-side apartments.

If escape is provided for from the roof into penthouse 59, then the electrical circuit will include red and green lights 49, 47 with only the green light energized.

In FIG. 5, the building 60 includes a single descending spiral escape chute 61. Said chute includes a series of connected chute segments similar to chute segments 21.

Access to said segments from floor-to-floor is the same as above-described including escape chutes 33, escape branch chutes 37 into the adjacent chute segment.

Having described my intention reference should now be had to the following claims.

I claim:

1. A fire escape chute for a building having a plurality of floors with hallways and a plurality of pairs of apartments with interior walls on each floor;

a plurality of vertically spaced aligned descending spiral chute segments positioned within the building and extending between adjacent floors;

each segment having an entrance on one floor and an exit upon a succeeding floor below;

a downwardly inclined escape chute for one of each of said pairs of apartments positioned within said building;

each escape chute having at one end an entrance opening within an interior wall of said one apartment, and an exit opening at its other end, said escape chute at its exit opening being connected to, merging and communicating with an adjacent chute segment for passage of a person thereinto;

and a downwardly inclined escape branch chute for the other of each of said pairs of apartments, positioned within said building, each escape chute branch having at one end an entrance opening within an interior wall of said other apartment, and an exit opening at its other end, said escape branch chute at said exit opening being connected to, merging and communicating with an adjacent escape chute for passage of a person thereinto and successively into the adjacent chute segment;

all of the persons using the escape chute and escape branch chutes successively passing therethrough and through the adjacent chute segment, successively exiting upon the adjacent lower floor.

2. In the fire escape chute of claim 1, further comprising persons exiting a chute segment walking the adjacent hallway and passing through the entrance of the adjacent succeeding chute segment and for successive passage through the succeeding chute segments to the ground floor.

3. In the fire escape chute of claim 1, further comprising a hinged door with a handle upon a wall in each apartment normally biased closed, extending over and across the entrance openings respectively of said escape chutes and escape branch chutes, limiting access thereinto.

4. In the escape chute of claim 3, further comprising a childproof safety latch on each door preventing access to said chutes.

5. In the fire escape chute of claim 3, further comprising red and green safety access signal lights mounted upon said apartment wall over said door, with said red light normally energized; and an electrical circuit including the signal lights for the apartments on each floor and succeeding floors;

an electrical power source connected into the circuit;

and a normally closed switch means in said circuit connected to said lights to progressively reverse the energization of each light successively from red to green for the safe, proper passage of persons into and through said escape chutes and escape branch chutes on a green light, permitting a progressive flow of users from adjacent pairs of apartments on each floor to the adjacent chute segment and for the progressive passage into and through the respective succeeding chute segments.

6. In the fire escape chute of claim 5, further comprising said switch means including proximity switches.

7. In the fire escape chute of claim 6, further comprising a traffic signal box enclosing each pair of red and green lights, mounted upon said wall and progressively switched from red to green.

8. In the fire escape chute of claim 1, a hinged door with a handle upon the exterior of an apartment wall within a hallway normally biased closed, extending over and across the entrance of a chute segment for controlled passage of persons on any floor into the entrance of the adjacent chute segment.

9. In the fire escape chute of claim 8, further comprising a childproof safety latch on each door preventing access to said chute segments.

10. In the fire escape chute of claim 8, further comprising red and green safety access signal lights mounted upon said apartment wall over said door with said red signal light normally energized;

an electrical circuit including the signal lights for the apartments of each floor and each succeeding floor;

an electrical power source connected to said circuit;

a red and a green safety access signal light mounted upon said wall over said door in said hallway with its red light normally energized; and normally closed switch means in said circuit connected to said lights, respectively, to progressively reverse the energization of each light successively from "red" to "green" for the safe, progressive passage of persons into and through said escape chutes and escape branch chutes on a green light, permitting a progressive flow of users from adjacent pairs of apartments on each floor through the adjacent chute segment and for progressive passage through succeeding chute segments.

11. The fire escape chute of claim 1, further comprising a flat roof overlying said building;

a penthouse having a normally closed door positioned upon said roof;

the entrance of the top chute segment communicating with said penthouse, to permit access and entry of persons on said roof to the entrance of said top chute segment.

12. A fire escape chute for a building having a plurality of floors and hallways and a plurality of pairs of apartments with interior walls on each floor;

a continuous descending spiral chute positioned within said building and including a plurality of connected spiral chute segments extending between adjacent floors;

said chute having an entrance at its top and an exit to a floor at ground level;

a downwardly inclined escape chute for one of each of said pair of apartments positioned within said building;

each escape chute having at one end an entrance opening within an interior wall of said one apartment, and an exit opening at its other end, said excape chute at its exit opening being connected to, merging and communicating with an adjacent chute segment for passage of persons thereinto;

and a downwardly inclined escape branch chute from the other of each of said pairs of apartments, positioned within said building, each escape chute branch having at one end an entrance opening within an interior wall of said other apartment, and an exit opening at its other end, said escape branch chute at said exit opening being connected to, merging and communicating with an adjacent escape chute for passage of a person thereinto and successively into the adjacent chute segment, all of the persons using the escape chute and escape branch chute successively passing therethrough through the adjacent chute segment of said spiral chute for ultimate progressive exit at the floor at ground level.

13. In the fire escape chute of claim 12, further comprising a hinged door with a handle on a wall in each apartment normally biased closed and extending over and across the entrance openings respectively of said escape chutes and escape branch chutes limiting access thereinto.

14. In the fire escape chute of claim 13, further comprising a childproof safety latch on each door preventing access to said chutes.

15. In the fire escape chute of claim 12, further comprising a red and green safety access signal lights mounted upon said wall over said door, with said signal light normally energized red;

an electrical circuit including the signal lights for the apartments for each floor and succeeding floors;

an electrical power source connected into said circuit;

and a switch means in said circuit connected to said lights to progressively reverse the energization of each light successively to green for the safe, proper passage of persons into and through said escape chutes and escape branch chutes on a green light, permitting a progressive flow of users from adjacent pairs of apartments on each floor to the adjacent chute segment and for progressive passage through the respective succeeding chute segments to the floor at ground level.

* * * * *